United States Patent [19]

Hirsch

[11] 3,991,921

[45] Nov. 16, 1976

[54] STRAP ASSEMBLY

[75] Inventor: Hermann Hirsch, Karnten, Austria

[73] Assignee: Hermann Hirsch Leder- und Kunststoffwarenfabrik, Karnten, Austria

[22] Filed: Sept. 2, 1975

[21] Appl. No.: 609,818

[30] Foreign Application Priority Data

Apr. 23, 1975 Austria ..... 3127/75

[52] U.S. Cl. ..... 224/4 D; 24/265 WS

[51] Int. Cl.[2] ..... A44C 5/14

[58] Field of Search ..... 224/4 D, 4 E, 4 F, 4 A, 224/28 W, 28 R; 24/265 WS, 265 R, 73 R, 198, 200; 63/5; 2/14 T, 14 V, 238; 58/57 R, 88 R, 23 BA; D10/32

[56] References Cited

UNITED STATES PATENTS

| | | | |
|---|---|---|---|
| 2,180,275 | 11/1939 | Boler | 24/265 WS |
| 2,439,274 | 4/1948 | Spector | 224/4 E |

FOREIGN PATENTS OR APPLICATIONS

| | | | |
|---|---|---|---|
| 343,693 | 2/1960 | Switzerland | 224/4 |

*Primary Examiner*—Robert J. Spar
*Assistant Examiner*—Lawrence E. Williams
*Attorney, Agent, or Firm*—Young & Thompson

[57] ABSTRACT

The strap assembly is adapted to be connected to at least one fixing bar having a width between a predetermined lower limit and a predetermined upper limit. A carrying strap is formed with transverse slot means. A fixing strap has first and second end portions and an intermediate portion and extends through said slot means and is adapted to extend around said fixing bar. Said first and second end portions are adapted to be secured to said carrying strap. Said first end portion has a width equal to said lower limit. Said second end portion has a width equal to said upper limit. Said intermediate portion merges in width into said first and second end portions and gradually increases in width from said first end portion to said second end portion.

4 Claims, 3 Drawing Figures

STRAP ASSEMBLY

This invention relates to a strap assembly for connection to watches or the like of differemt sizes.

It is known to connect a carrying strap to a watch or the like by means of a fixing strap, which extends through fixing bars provided on the watch or the like and through slots in the carrying strap and which is joined to the underside of the carrying strap, e.g., by being adhered thereto. Such carrying straps must be held in storage in different sizes to fit the watches or the like of different sizes. Fixing straps differing in width must also be provided in dependence on the width of the fixing bar of the watch or the like. The slots in the carrying straps must also correspond to the different sizes of the watches or the like. For watches or the like, carrying straps having widths from 8 mm to 18 mm must be provided. The storage of straps for watches or the like in widely varying sizes is complicated. Besides, numerous tools must be kept on stock for the manufacture of these different sizes.

It is an object of the invention to provide a strap assembly which may be used with watches or the like in all sizes which are available so that the storage is simplified and the manufacture is less expensive. It is desired to enable the watch or the like to be connected to the carrying strap reliably and in a simple manner.

To accomplish this object, an essential feature of the strap assembly according to the invention for connecting to watches or the like of different sizes resides in that the carrying strap is formed with one or more slots for each fixing bar of the watch or the like, and a fixing strap is adapted to be passed through said slot or slots so as to form a loop strap, which extends around the fixing bar of the watch or the like, the ends of the fixing strap are joined to the carrying strap preferably on the underside thereof, one end of the fixing strap has a width which is equal to the width of the fixing bar of a smallest watch or the like, the other end of the fixing strap has a width which is equal to the width of the fixing bar of a largest watch or the like, and an intermediate portion of the fixing strap at one end thereof to the width of the fixing strap at the other end thereof to fit fixing bars of watches or the like of intermediate sizes.

To connect the fixing straps to the carrying strap, it is a preferred feature of the invention that the carrying strap has at least one hole for each fixing bar of the watch or the like and each fixing strap is provided with a series of holes to enable a connection of the fixing strap to the carrying strap by means of a split pin or the like.

Details of the invention will be explained more fully with reference to the accompanying drawing, in which embodiments of the strap assembly according to the invention are shown diagrammatically and by way of example.

Figure 1:
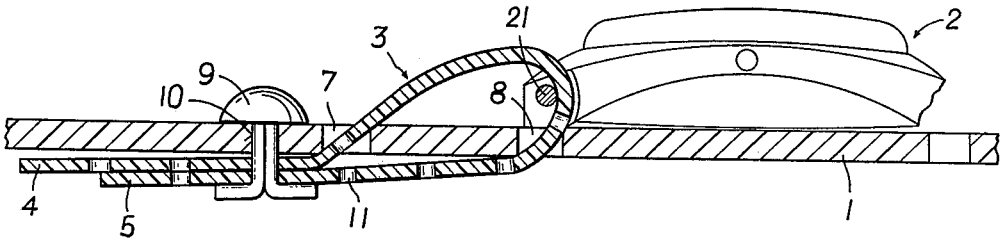
Figure 2:
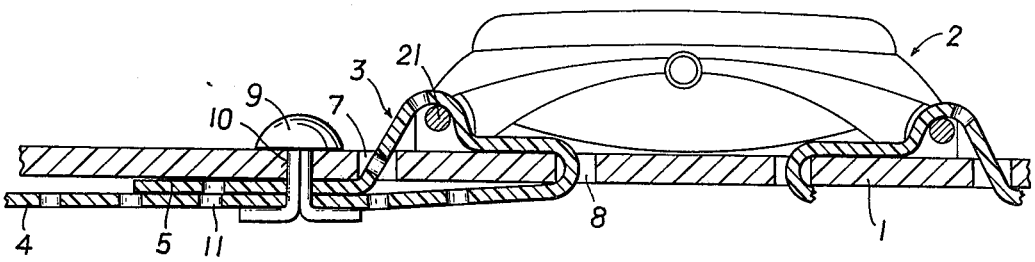
Figure 3:
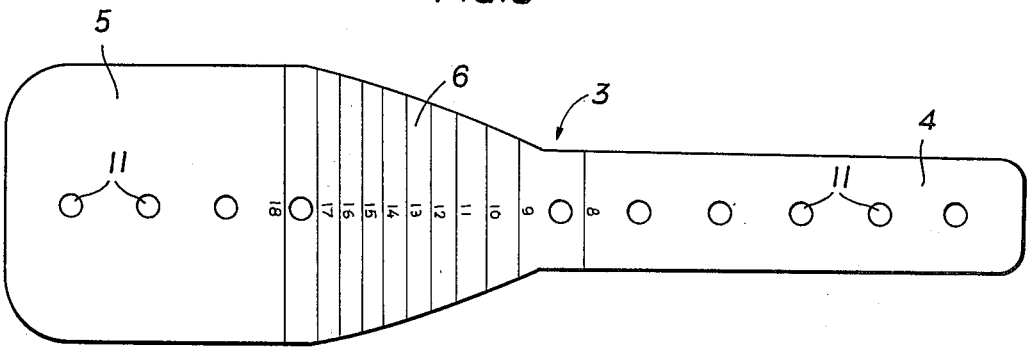

FIG. 1 is a partly sectional view showing a strap assembly according to the invention and a lady's watch connected thereto, FIG. 2 is a partly sectional view showing a strap assembly according to the invention and a man's watch connected thereto, and FIG. 3 is a top plan view showing a fixing strap for connecting a carrying strap to watches or the like differing in size.

In the embodiment shown in FIG. 1, a lady's watch 2 is secured to a carrying strap 1 by means of fixing straps 3, which have at one end 4 a width corresponding to the width of a fixing bar of a smallest watch or the like and have at the other end 5 a width corresponding to the fixing bar of a largest watch or the like. The narrow end 4 of the fixing strap is connected to the wide end 5 of the fixing strap by an intermediate portion 6 (see FIG. 3), which has a tapered configuration which is symmetrical to the center line of the fixing strap 3 so that the latter can connect the carrying strap 1 to watches or the like of different sizes. The carrying strap 1 has transverse slots 7 and 8, through which the fixing strap 3 extends. To connect a lady's watch 2 according to FIG. 1 to the carrying strap, the narrow end 4 of the fixing strap 3 is passed through the slot 8 and then behind the fixing bar 21 of the watch or the like and finally through the slot 7 and the fixing strap is then advanced until the fixing strap 3 engages the fixing bar 21 of the watch or the like with a portion which is as wide as said fixing bar. The ends of the fixing strap are now disposed on the underside of the carrying strap 1 and are connected to the latter by split pins 9, which extends through a hole 10 in the carrying strap 1 and any of a series of holes 11 in the fixing strap 3 so that the split pin may be located in dependence on the position of the fixing strap 3.

To connect the carrying strap 1 to a man's watch as shown in FIG. 2, it is suitable to pass the narrow end 4 of the fixing strap 3 through the slot 7 in the carrying strap 1 and then around the fixing bar 21 of the watch or the like and finally through the slot 8 in the carrying strap 1. The fixing strap 3 is then pulled until that part thereof which is as wide as the fixing bar 21 of the watch or the like is disposed at said fixing bar. The fixing strap 3 is then fixed in position by means of a split pin 9.

The embodiment of the strap assembly according to the invention which has been described and is shown on the drawing serves only for an explanation of the nature of the invention and the latter is not restricted to details. Within the scope of the invention, the fixing strap 3 may extend only through one of the slots 7 or 8 to connect a watch or the like to the carrying strap 1. The strap assembly according to the invention may also comprise carrying straps of any desired kind which are to be connected to altimeters, depthometers, compasses, and the like.

What is claimed is:

1. A strap assembly adapted to be connected to at least one fixing bar having a width between a predetermined lower limit and a predetermined upper limit, which comprises a carrying strap formed with transverse slot means, a fixing strap having first and second end portions and an intermediate portion and extending through said slot means and adapted to extend around said fixing bar, said first and second end portions being adapted to be secured to said carrying strap, said first end portion having a width equal to said lower limit, said second end portion having a width equal to said upper limit, said intermediate portion merging in width into said first and second end portions and gradually increasing in width from said first end portion to said second end portion.

2. A strap assembly as set forth in claim 1, in which said transverse slot means comprise two transverse slots spaced apart in the longitudinal direction of said carrying strap, said fixing strap extends through both said transverse slots, and said first and second end portions have free ends disposed on one side of said carrying strap.

3. A strap assembly as set forth in claim 1, in which said carrying strap is formed with a hole and each of said end portions is formed with a series of holes, each of which is adapted to register with said hole in said straps so that said end portions are adapted to be secured to said carrying strap by means of a split pin extending through said hole in said carrying strap and one hole in each of said end portions.

4. A strap assembly as set forth in claim 1, which is adapted to be connected to said fixing bar and to an additional fixing bar which is transversely spaced from said first-mentioned fixing bar and has a width between said limits, in which said carrying strap is formed with additional transverse slot means, an additional fixing strap is provided, which has first and second end portions and an intermediate portion and extends through said additional slot means and is adapted to extend around said additional fixing bar, said first and second end portions of said additional fixing strap being adapted to be secured to said carrying strap, said first and second end portions of said additional fixing strap are adapted to be secured to said main carrying strap, said first end portions of said additional fixing strap have a width equal to said upper limit, said intermediate portion of said additional fixing strap merges in width into said first and second end portions of said additional fixing strap and gradually increases in width from said first end portion to said second end portion of said additional fixing strap.

* * * * *